US006859092B2

(12) United States Patent
Lukes et al.

(10) Patent No.: US 6,859,092 B2
(45) Date of Patent: Feb. 22, 2005

(54) METHOD AND LOW VOLTAGE CMOS CIRCUIT FOR GENERATING VOLTAGE AND CURRENT REFERENCES

(75) Inventors: Eric John Lukes, Stewartville, MN (US); Patrick Lee Rosno, Rochester, MN (US); James David Strom, Rochester, MN (US); Dana Marie Woeste, Mantorville, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/418,569

(22) Filed: Apr. 17, 2003

(65) Prior Publication Data

US 2004/0207460 A1 Oct. 21, 2004

(51) Int. Cl.[7] ..... G05F 1/10; G05F 3/02
(52) U.S. Cl. ..... 327/540; 327/543
(58) Field of Search ..... 327/530, 538, 327/540, 541, 543; 323/315, 316

(56) References Cited

U.S. PATENT DOCUMENTS 4,825,145 A * 4/1989 Tanaka et al. ..... 323/315
5,841,271 A * 11/1998 Nakayama ..... 323/316
6,255,807 B1 * 7/2001 Doorenbos et al. ..... 323/314
6,677,802 B2 * 1/2004 Strom et al. ..... 327/534

* cited by examiner

*Primary Examiner*—Quan Tra
(74) *Attorney, Agent, or Firm*—Joan Pennington

(57) ABSTRACT

A method and a low voltage, complementary metal oxide semiconductor (CMOS) circuit are provided for generating voltage and current references with a low voltage power supply. A voltage generating circuit provides a voltage reference and is formed by a plurality of CMOS transistors and a resistor. An operational amplifier includes a differential pair of CMOS transistors. The first voltage reference is applied to an input of the differential pair of transistors and an output of the differential pair of transistors providing a second voltage reference. The operational amplifier includes a plurality of current reference transistors. A first voltage generating circuit generates a first voltage and a second voltage generating circuit generating a second voltage. The first and second voltage generating circuits are formed by a plurality of CMOS transistors. The generated first and second voltages are applied to the voltage reference generating circuit and current reference transistors.

18 Claims, 2 Drawing Sheets

METHOD AND LOW VOLTAGE CMOS CIRCUIT FOR GENERATING VOLTAGE AND CURRENT REFERENCES

FIELD OF THE INVENTION

The present invention relates generally to the data processing field, and more particularly, relates to a method for generating voltage and current references with a low voltage power supply and a low voltage, complementary metal oxide semiconductor (CMOS) circuit for generating voltage and current references.

DESCRIPTION OF THE RELATED ART

A problem of using conventional voltage and current reference generator arrangements at low voltages is that diodes typically have been used as references. With a low voltage power supply, for example, at 0.7V, the typical threshold voltage of a diode is too large to be used to provide a voltage reference.

A need exists for a mechanism for effectively generating low voltage, voltage and current references. A need exists to generate voltage and current references that are stable over temperature and voltage and that can be used at much lower power supply voltages than the conventional power supply arrangements.

SUMMARY OF THE INVENTION

Principal objects of the present invention are to provide a method for generating voltage and current references with a low voltage power supply and a low voltage, complementary metal oxide semiconductor (CMOS) circuit for generating voltage and current references. Other important objects of the present invention are to provide such method and low voltage, complementary metal oxide semiconductor (CMOS) circuit for generating voltage and current references substantially without negative effect and that overcome many of the disadvantages of prior art arrangements.

In brief, a method and a low voltage, complementary metal oxide semiconductor (CMOS) circuit are provided for generating voltage and current references with a low voltage power supply. A voltage generating circuit provides a voltage reference and is formed by a plurality of CMOS transistors and a resistor. An operational amplifier includes a differential pair of CMOS transistors and a plurality of current reference transistors. The first voltage reference is applied to an input of the differential pair of transistors and an output of the differential pair of transistors providing a second voltage reference. A first voltage generating circuit generates a first voltage and a second voltage generating circuit generating a second voltage. The first and second voltage generating circuits are formed by a plurality of CMOS transistors. The generated first and second voltages are applied to the voltage reference generating circuit and at least a pair of the current reference transistors.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENT

Figure 1A:
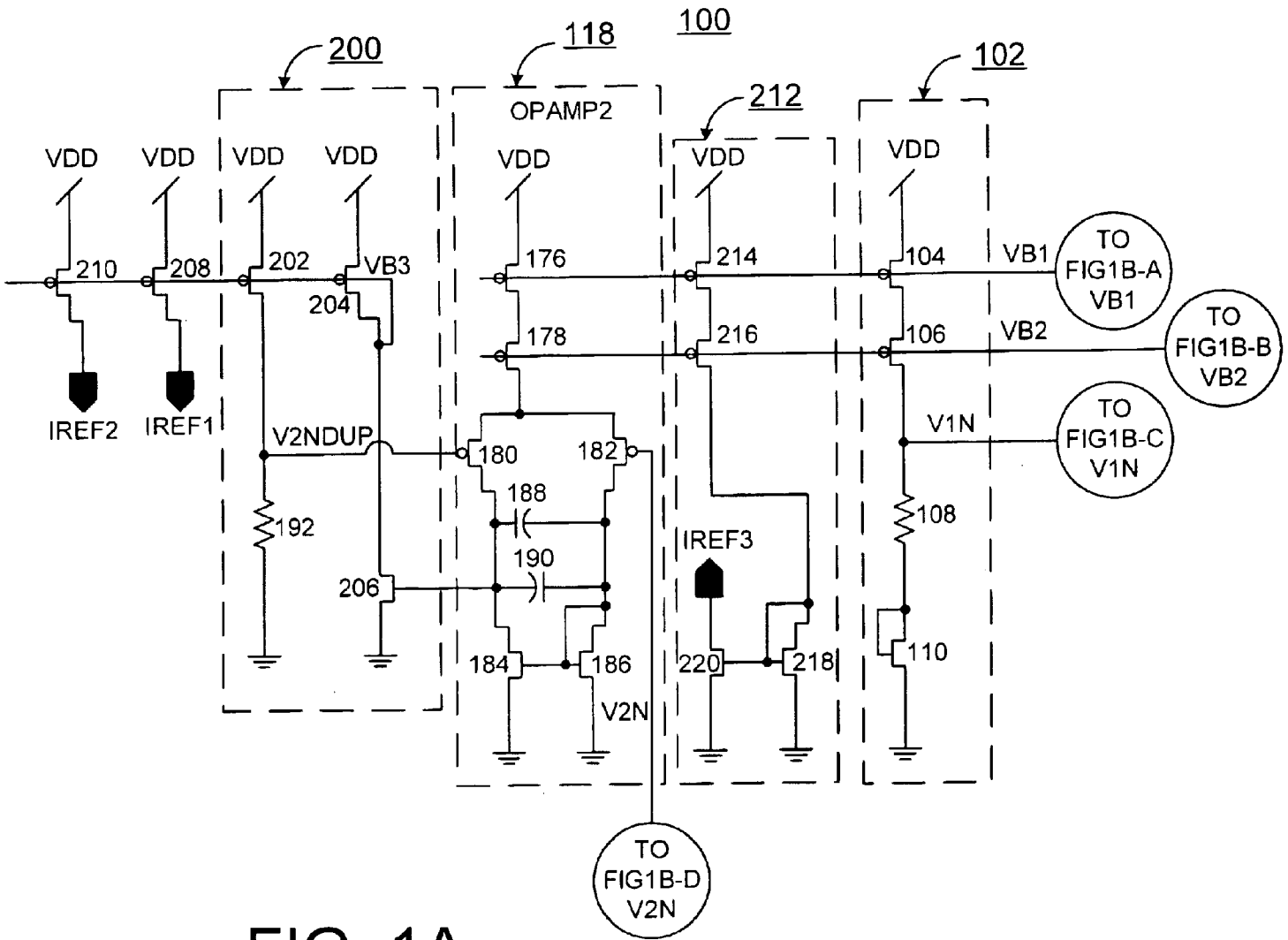
FIGS. 1A and 1B together provide a schematic diagram representation of an exemplary silicon-on-insulator (SOI) complementary metal oxide semiconductor (CMOS) circuit for generating low voltage, voltage and current references in accordance with the preferred embodiment.
Figure 1B:
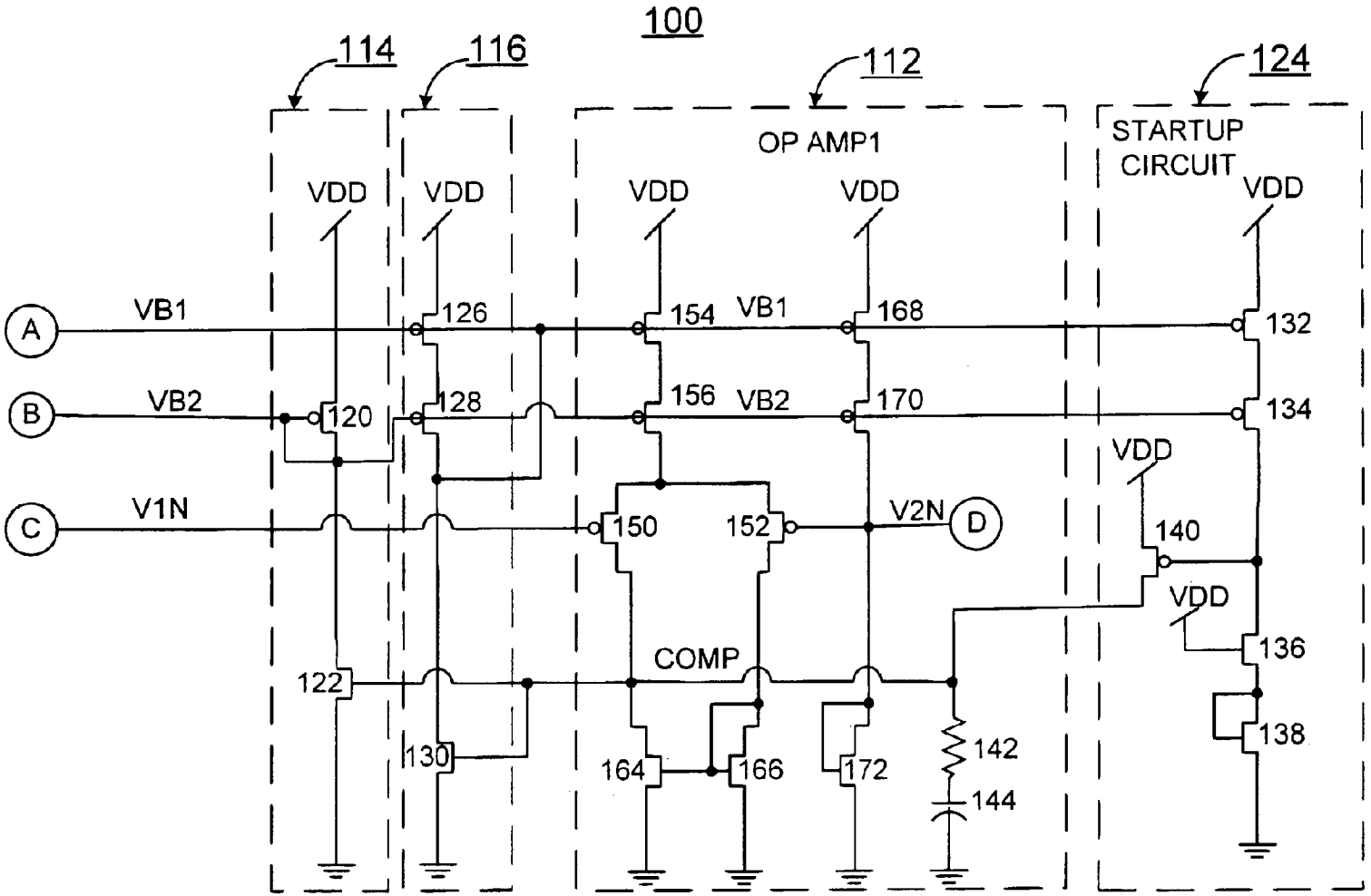

Having reference now to the drawings, in FIGS. 1A and 1B, there is shown an exemplary circuit for generating voltage and current references in accordance with the preferred embodiment generally designated by the reference character 100. Voltage reference and current reference generator circuit 100 can be used at a low voltage power supply labeled VDD, for example, 0.7 volts.

In accordance with features of the preferred embodiment, voltage and current references are generated using only silicon-on-insulator (SOI) complementary metal oxide semiconductor (CMOS) devices and resistors. As shown in FIGS. 1A and 1B, voltage reference and current reference generator circuit 100 generates stable voltage references, each for input to an operational amplifier, and current references that are stable over temperature, voltage and process using only SOI field effect transistors (FETs), such as metal oxide semiconductor FETs (MOSFETs), and resistors. An advantage is that voltage reference and current reference generator circuit 100 can be used at much lower power supply voltages than the conventional arrangement.

Referring to FIG. 1A, voltage reference and current reference generator circuit 100 includes a voltage reference generating circuit in accordance with the preferred embodiment generally designated by the reference character 102. Voltage reference generating circuit 102 is formed by a pair of SOI P-channel field effect transistors (PFETs) 104, 106, a resistor 108 and an SOI N-channel field effect transistor (NFET) 110. PFETs 104, 106, resistor 108 and NFET 110 are connected in series between a low voltage power supply labeled VDD and ground. A gate of PFET 104 and a gate of PFET 106 respectively are connected to a voltage or node respectively labeled VB1 and VB2. A gate of NFET 110 is connected to the junction connection of the resistor 108 and NFET 110.

Referring also to FIG. 1B, voltage reference generating circuit 102 generates a stable reference voltage V1N for an input to an operational amplifier OPAMP1 generally designated by the reference character 112. The reference voltage V1N is generated at the junction connection of PFET 106 and resistor 108. A type of resistor that is used for resistor 108 can influence the characteristics of the stable reference voltage V1N. For example, a resistor can be used for resistor 108 having a temperature coefficient that is opposite and substantially equal to a temperature coefficient of NFET 110 to provide a substantially constant reference voltage V1N over varying temperature.

Circuit 100 includes a first voltage generating circuit and a second voltage generating circuit in accordance with the preferred embodiment respectively generally designated by the reference characters 114, 116. The first voltage generating circuit 114 and the second voltage generating circuit 116 generate the voltages applied to voltage reference generating circuit 102, OP AMP1 112, and OP AMP2 118 at voltages or nodes respectively labeled VB2 and VB1.

OP AMP1 112 generates a reference voltage indicated at node V2N that can be used as a reference of other operational amplifiers, such as OP AMP2 118 shown in FIG. 1A.

First voltage generating circuit 114 includes a PFET 120 and an NFET 122 connected in series between the low voltage power supply VDD and ground. The first voltage generating circuit 114 generates the voltage labeled VB2 at the junction connection of PFET 120 and NFET 122. A source of PFET 120 is connected to the low voltage power supply VDD. A common gate and drain connection of PFET 120 is connected to a drain of the NFET 122. The source of NFET 122 is connected to ground and a gate of NFET 122 is connected to a startup circuit generally designated 124 at a node labeled COMP.

The second voltage generating circuit 116 includes a pair of PFETs 126, 128 and an NFET 130 connected in series between the low voltage power supply VDD and ground. The second voltage generating circuit 114 generates the voltage labeled VB1 at the junction connection of PFET 128 and NFET 130. A source of PFET 126 is connected to the low voltage power supply VDD. A gate of PFET 126 is connected to node VB1 and a drain of PFET 126 is connected to a source of PFET 128. A gate of PFET 128 is connected to the drain connection of PFET 120 and NFET 122 of the first voltage generating circuit 114 at node VB2. A drain of PFET 128 is connected to a drain of the NFET 130. The source of NFET 130 is connected to ground and a gate of NFET 130 is connected to the startup circuit 124 at node COMP.

In accordance with features of the preferred embodiment, the cascading of the PFETs 120, 126, 128 of voltage generating circuits 114, 116 for the current references causes the circuit 100 to be less sensitive to variations in the low voltage power supply VDD. The generation of voltage VB2 separately from voltage VB1 improves the performance of circuit 100 at lower power supply voltages.

Startup circuit 124 ensures proper startup conditions for circuit 100 including all of the feedback loops in combination with OP AMP1 112. Startup circuit 124 includes a pair of PFETs 132, 134 and a pair of NFETs 136, 138 connected in series between the low voltage power supply VDD and ground and a PFET 140. The voltage VB1 is applied to the gate of PFET 132 and voltage VB2 is applied to the gate of PFET 134. The gate of NFET 136 is connected to the low voltage power supply VDD. The gate of NFET 138 is connected to the junction connection of NFETs 136, 138. A source of PFET 140 is connected to the low voltage power supply VDD with the gate of PFET 140 connected to the junction connection of PFET 134 and NFET 136. The drain of PFET 140 is connected at node COMP to OP AMP1 112, and to voltage generating circuits 114, 116.

OP AMP1 112 generates the reference voltage V2N that is very stable and is used as a reference voltage input to OP AMP2 118. OP AMP1 112 includes a series connected resistor 142 and a capacitor 144 connected between node COMP and ground. Resistor 142 and capacitor 144 are added to OP AMP1 112 for stability. OP AMP1 112 includes a differential pair of PFETs 150, 152. A pair of series connected current mirror PFETs 154, 156 is connected between the low voltage power supply VDD and a drain of each of differential pair of PFETs 150, 152. A pair of NFETs 164 and 166 is respectively connected between the drain of PFETs 150, 152 and ground. A gate and drain of NFET 166 is connected to a gate of NFET 164.

OP AMP1 112 includes a pair of reference current generator PFETs 168, 170, each having a respective gate input of VB1, VB2, connected in series with an NFET 172 between VDD and ground. A drain and a gate of NFET 172 are connected to a drain of PFET 170. Reference voltage V2N is generated at the drain and source connection of PFET 170 and NFET 172.

Referring again to FIG. 1A, the voltages VB1 and VB2 also can be used to generate stable current mirrors as shown in OP AMP2 118. OP AMP2 118 includes a pair of current mirror PFETs 176, 178, each having a respective gate input of VB1, VB2. Current mirror PFETs 176, 178 are connected in series between the low voltage power supply VDD and a source of each of a differential pair of PFETs 180, 182. OP AMP2 118 includes a pair of NFETs 184 and 186 respectively connected between a drain of differential pair PFETs 180, 182 and ground. A gate and drain of NFET 186 is connected to a gate of NFET 184. A pair of capacitors 188, 190 is added to OP AMP2 118 for stability. Capacitors 188, 190 are connected between the drain connections of PFET 180 and NFET 184, and PFET 182 and NFET 186. The capacitors 188, 190 are connected in parallel as shown to provide substantially equal capacitance independent of the direction of current flow.

Reference voltage V2N generated by OP AMP1 112 is applied to a gate input of differential pair PFET 182 of OP AMP2 118. As shown, OP AMP2 118 also is used to generate current references that are not based on voltages VB1 and VB2. The OPAMP uses the stable voltage reference V2N to force a duplicate voltage V2N across a resistor 192 at node labeled V2NDUP. Resistor 192 is connected between the gate of differential pair PFET 180 and ground.

A current mirror generally designated by reference character 200 includes a pair of PFETs 202, 204, the resistor 192, and an NFET 206. The PFETs 202, 204, the resistor 192, and NFET 206 form the current mirror 200 generating voltage reference VB3. PFET 202 is connected between the low voltage supply VDD and node V2NDUP at the junction connection of resistor 192 and a gate of differential pair PFET 182 of OP AMP2 118. PFET 204 and NFET 206 are connected in series between the low voltage supply VDD and ground. A gate of PFET 202 is connected to a gate of PFET 204 at node voltage reference VB3. The gate of PFET 204 is connected to the drain connections of PFET 204 and NFET 206. By sizing a pair of additional PFETs 208, 210 properly with respect to PFETs 202, 204, multiples of the stable current in PFET 202 can be reproduced, for example, in a pair of PFETs 208, 210, each having a gate connected to VB3, a source connected to the low voltage power supply VDD, and a drain providing respective current reference labeled IREF1, IREF2. For example, current mirror 200 generates a stable 100 mA current reference IREF1 and a stable 250 mA current reference IREF2.

Another example current mirror is generally designated by reference character 212. Current mirror 212 is a stable current mirror that uses VB1 and VB2 as reference voltages. A pair of PFETs 214, 216 and a pair of NFETs 218, 220 form current mirror 212. PFETs 214, 216 and NFET 218 are connected in series between the low voltage power supply VDD and ground. A gate input of VB1 is applied to PFET 214 and a gate input of VB2 is applied to PFET 216. The gate of NFET 218 is connected to a gate of NFET 220 and to the drain connections of PFET 216 and NFET 218. Current mirror 212 generates a stable current reference at an output labeled IREF3 provided at a drain of NFET 220 with a source of NFET 220 connected to ground. For example, current mirror 212 generates a stable 25 mA current reference IREF3.

In circuit 100, size ratios between NFET 110 in voltage reference generating circuit 102, and NFET 172 in OP AMP1 112 can influence the characteristics of the generated current references. In circuit 100, substantially identical devices are used for transistors respectively connected to VB1, VB2. For example, PFETs 104 and 106 in voltage reference generating circuit 102 are substantially identical to PFETs 168 and 170 in OPAMP1 112.

While the present invention has been described with reference to the details of the embodiments of the invention shown in the drawing, these details are not intended to limit the scope of the invention as claimed in the appended claims.

What is claimed is:

1. A low voltage, complementary metal oxide semiconductor (CMOS) circuit for generating voltage and current references comprising:

a voltage reference generating circuit providing a first voltage reference, said voltage reference generating circuit being formed by a resistor and a pair of series connected silicon-on-insulator (SOI) field effect transistors (FETs) connected to said resistor; and a third SOI field effect transistor (FET); said pair of series connected silicon-on-insulator (SOI) field effect transistors (FETs), said resistor, and said third SOI field effect transistor (FET) are connected in series between a low voltage power supply and ground;

an operational amplifier including a differential pair of CMOS transistors and a plurality of current reference transistors; said first voltage reference applied to an input of said differential pair of transistors and an output of said differential pair of transistors providing a second voltage reference;

a first voltage generating circuit generating a first voltage;

a second voltage generating circuit generating a second voltage; said first and second voltage generating circuit being formed by a plurality of CMOS transistors; and said first and second voltages being applied to said voltage reference generating circuit and at least a pair of said current reference transistors.

2. A low voltage, complementary metal oxide semiconductor (CMOS) circuit as recited in claim 1 wherein said pair of series connected silicon-on-insulator (SOI) field effect transistors (FETs) are P-channel field effect transistors (PFETs); and said first voltage is applied to a gate of one of said pair of PFETs and said second first voltage is applied to a gate of the other of said pair of PFETs.

3. A low voltage, complementary metal oxide semiconductor (CMOS) circuit as recited in claim 1 wherein said third SOI field effect transistor (FET) is an N-channel field effect transistor (NFET) and a gate of said NFET is connected to a junction connection of said resistor and said NFET.

4. A low voltage, complementary metal oxide semiconductor (CMOS) circuit as recited in claim 1 wherein said differential pair of transistors includes a differential pair of P-channel field effect transistors (PFETs).

5. A low voltage, complementary metal oxide semiconductor (CMOS) circuit as recited in claim 4 includes a pair of current mirror transistors; said pair of current mirror transistors are P-channel field effect transistors (PFETs); said current mirror PFETs are connected in series between said low voltage power supply and a source of each of said differential pair of PFETs.

6. A low voltage, complementary metal oxide semiconductor (CMOS) circuit as recited in claim 5 wherein said first voltage is applied to a gate of one of said current mirror PFETs and said second voltage is applied to a gate of the other of said current mirror PFETs.

7. A low voltage, complementary metal oxide semiconductor (CMOS) circuit as recited in claim 5 wherein said operational amplifier includes a pair of N-channel field effect transistors (NFETs), one NFET connected between a drain of one of said differential pair of PFETs and ground, and the other NFET connected between a drain of the other one of said differential pair of PFETs and ground.

8. A low voltage, complementary metal oxide semiconductor (CMOS) circuit as recited in claim 5 wherein said operational amplifier includes a resistor and a capacitor connected in series between said drain of one of said differential pair of PFETs and ground.

9. A low voltage, complementary metal oxide semiconductor (CMOS) circuit as recited in claim 5 wherein said plurality of current reference transistor includes series-connected first and second reference current generator PFETs connected in series to an NFET; said series-connected first and second reference current generator PFETs and said NFET connected between said low voltage power supply and ground; said first voltage is applied to a gate of said first reference current generator PFET and said second voltage is applied to a pate of said second reference current generator PFET.

10. A low voltage, complementary metal oxide semiconductor (CMOS) circuit as recited in claim 9 wherein said second voltage reference is provided at said output of said differential pair of transistors; said output connected to a connection of a drain of said second reference current generator PFET and a drain of said series-connected NFET.

11. A low voltage, complementary metal oxide semiconductor (CMOS) circuit as recited in claim 1 wherein said first voltage generating circuit generating said first voltage includes a pair of series connected silicon-on-insulator (SOI) field effect transistors (FETs).

12. A low voltage, complementary metal oxide semiconductor (CMOS) circuit for generating voltage and current references comprising:

a voltage reference generating circuit providing a first voltage reference, said voltage reference generating circuit being formed by a plurality of CMOS transistors and a resistor;

an operational amplifier including a differential pair of CMOS transistors and a plurality of current reference transistors; said first voltage reference applied to an input of said differential pair of transistors and an output of said differential pair of transistors providing a second voltage reference;

a first voltage generating circuit generating a first voltage; said first voltage generating circuit including a pair of series connected silicon-on-insulator (SOI) field effect transistors (FETs); said pair of series connected silicon-on-insulator (SOI) field effect transistors (FETs) including a P-channel field effect transistor (PFET) and a N-channel field effect transistor (NFET) connected in series between a low voltage power supply and ground; and said first voltage being provided at a connection of a drain of said PFET and a drain of said NFET;

a second voltage generating circuit generating a second voltage; said second voltage generating circuit being formed by a plurality of CMOS transistors; and said first and second voltages being applied to said voltage reference generating circuit and at least a pair of said current reference transistors.

13. A low voltage, complementary metal oxide semiconductor (CMOS) circuit as recited in claim 12 wherein said second voltage generating circuit generating said second voltage includes a second pair of series connected silicon-on-insulator (SOI) P-channel field effect transistors (PFETs) connected in series with a third SOI N-channel field effect transistor (NFET); said second pair of series connected PFETs including a first PFET connected to said low voltage power supply and a second PFET connected in series with said third NFET of said second voltage generating circuit; said first voltage provided at said connection of said drain of said PFET and said drain of said NFET of said first voltage generating circuit applied to a gate of said second PFET of said second voltage generating circuit; and said second voltage is provided at a connection of a drain of said second PFET and a drain of said third NFET of said second voltage generating circuit.

14. A low voltage, complementary metal oxide semiconductor (CMOS) circuit for generating voltage and current references comprising:

a voltage reference generating circuit providing a first voltage reference, said voltage reference generating circuit being formed by a plurality of CMOS transistors and a resistor;

an operational amplifier including a differential pair of CMOS transistors and a plurality of current reference transistors; said first voltage reference applied to an input of said differential pair of transistors and an output of said differential pair of transistors providing a second voltage reference;

a first voltage generating circuit generating a first voltage;

a second voltage generating circuit generating a second voltage; said first and second voltage generating circuit being formed by a plurality of CMOS transistors; and said first and second voltages being applied to said voltage reference generating circuit and at least a pair of said current reference transistors;

a startup circuit coupled to said voltage reference generating circuit providing a first voltage reference and to said operational amplifier.

15. A low voltage, complementary metal oxide semiconductor (CMOS) circuit as recited in claim 14 includes a second operational amplifier including a second differential pair of CMOS transistors, said second voltage reference of said first operational amplifier applied to an input of said second differential pair of transistors and an output of said second differential pair of transistors providing a duplicate second voltage reference.

16. A low voltage, complementary metal oxide semiconductor (CMOS) circuit as recited in claim 15 includes a current mirror generating a third reference voltage; said current mirror including a resistor connected between said duplicate second voltage reference and ground, a first P-channel field effect transistor (PFET) connected between said low voltage supply and junction connection of said resistor and said duplicate second voltage reference; a second PFET series connected with an N-channel field effect transistor (NFET); said second PFET and said NFET are connected between said low voltage supply and ground; a gate of said second PFET is connected to a gate of said first PFET and to a connection of a drain of said second PFET and a drain of said NFET; said third reference voltage provided at said gate of said second PFET.

17. A low voltage, complementary metal oxide semiconductor (CMOS) circuit as recited in claim 14 includes a current mirror coupled to said voltage reference generating circuit; said current mirror includes a pair of P-channel field effect transistors (PFETs) and a first N-channel field effect transistor (NFET) and a second NFET; said pair of PFETs and said first NFET are connected in series between said low voltage power supply and ground; said first voltage is applied to a gate of a first one of said pair of PFETs and said second voltage is applied to a gate of a second one of said pair of PFETs; a gate of first NFET is connected to a gate of said second NFET and to a connection of a drain of said second PFET and a drain of said first NFET; a source of said second NFET is connected to ground; and a current reference output is provided at a drain of said second NFET.

18. A low voltage, complementary metal oxide semiconductor (CMOS) circuit as recited in claim 14 wherein said voltage reference generating circuit providing said first voltage reference includes a resistor and a pair of series connected silicon-on-insulator (SOI) field effect transistors (FETs) connected to said resistor.

* * * * *